US011719263B2

(12) United States Patent
Hill et al.

(10) Patent No.: US 11,719,263 B2
(45) Date of Patent: Aug. 8, 2023

(54) VARIABLE RECRUITMENT ACTUATOR SYSTEMS AND RELATED METHODS

(71) Applicant: Adaract Technologies, Ltd., Reno, NV (US)

(72) Inventors: Joseph Hill, Reno, NV (US); Francis Budu-Manuel, Reno, NV (US)

(73) Assignee: Adaract Technologies, Ltd., Reno, NV (US)

( * ) Notice: Subject to any disclaimer, the term of this patent is extended or adjusted under 35 U.S.C. 154(b) by 0 days.

(21) Appl. No.: 17/689,352

(22) Filed: Mar. 8, 2022

(65) Prior Publication Data

US 2022/0307523 A1 Sep. 29, 2022

Related U.S. Application Data

(60) Provisional application No. 63/165,411, filed on Mar. 24, 2021.

(51) Int. Cl.
*F15B 15/10* (2006.01)
*F15B 15/20* (2006.01)
(Continued)

(52) U.S. Cl.
CPC ..... *F15B 15/103* (2013.01); *F15B 15/202* (2013.01); *F15B 1/021* (2013.01); *F15B 11/036* (2013.01); *F15B 13/027* (2013.01); *F15B 2211/20538* (2013.01); *F15B 2211/212* (2013.01); *F15B 2211/30505* (2013.01); *F15B 2211/30585* (2013.01); *F15B 2211/31564* (2013.01); *F15B 2211/6306* (2013.01); *F15B 2211/6309* (2013.01); *F15B 2211/6313* (2013.01); *F15B 2211/665* (2013.01);
(Continued)

(58) Field of Classification Search
CPC .... F15B 15/103; F15B 15/202; F15B 11/036; F15B 2211/20538; F15B 2211/212; F15B 2211/30505; F15B 2211/30585; F15B 2211/31564; F15B 2211/6309; F15B 2211/6313; F15B 2211/665; F15B 2211/6655; F15B 2211/7107; F15B 2211/7142; F15B 2211/78; F15B 2211/30; B25J 9/1075; B25J 9/142
See application file for complete search history.

(56) References Cited

U.S. PATENT DOCUMENTS 4,190,081 A * 2/1980 Coles ..... F15B 13/0402 137/625.65
4,792,173 A * 12/1988 Wilson ..... B25J 9/142 92/92

(Continued)

*Primary Examiner* — Dustin T Nguyen
(74) *Attorney, Agent, or Firm* — PCFB Attorneys at Law; Jared L. Cherry

(57) ABSTRACT

The present disclosure relates to variable recruitment actuator systems and related methods. In one embodiment, a variable recruitment actuator system may include a high-pressure fluid connection and a plurality of actuators. A variable recruitment actuator mechanism may selectively recruit a subset of the plurality of actuators based on a position of the variable recruitment actuator mechanism by selectively placing the subset of the plurality of actuators in fluid communication with the high-pressure fluid connection. A control system to control the position of the variable recruitment actuator mechanism may operate based on an input from a user.

12 Claims, 16 Drawing Sheets

(51) Int. Cl.
*F15B 1/02* (2006.01)
*F15B 13/02* (2006.01)
*F15B 11/036* (2006.01)

(52) U.S. Cl.
CPC ..... *F15B 2211/6655* (2013.01); *F15B 2211/7107* (2013.01); *F15B 2211/7142* (2013.01); *F15B 2211/765* (2013.01); *F15B 2211/78* (2013.01); *F15B 2215/30* (2013.01)

(56) References Cited

U.S. PATENT DOCUMENTS 4,794,912 A * 1/1989 Lia ..... A61B 1/0053 92/92
6,431,050 B1 * 8/2002 Hausman ..... E02F 9/2225 91/526
7,866,286 B2 * 1/2011 Sun ..... F01L 9/10 123/90.12
8,051,764 B2 * 11/2011 Jacobsen ..... F15B 13/0402 91/530
8,201,473 B2 * 6/2012 Knoll ..... B25J 19/0025 74/490.05
8,700,215 B2 * 4/2014 Komatsu ..... B25J 9/142 714/48
2017/0328381 A1 * 11/2017 Goto ..... F15B 13/06
2020/0300275 A1 * 9/2020 Biwersi ..... F15B 13/0444

* cited by examiner 11
1
2
3
4
5
6
7
8
9
10

VARIABLE RECRUITMENT ACTUATOR SYSTEMS AND RELATED METHODS

RELATED APPLICATION

This application claims priority from and benefit of U.S. Provisional Application Ser. No. 63/165,411, filed on Mar. 24, 2021, entitled "VARIABLE RECRUITMENT ACTUATOR AND METHOD" which is hereby incorporated by reference in its entirety for all purposes.

TECHNICAL FIELD

The present disclosure relates to a hydraulic actuator and a method for controlling a hydraulic system using a plurality of said actuators. More particularly, the invention relates to a variable recruitment actuator comprising a plurality of actuators that may be active or passive, depending on the desired behavior of the actuator.

BRIEF DESCRIPTION OF THE DRAWINGS

Some embodiments of the present invention are illustrated as examples and are not limited by figures of the following drawings, in which like references may indicate similar elements and in which.

DETAILED DESCRIPTION

Figures 1, 3, 5:
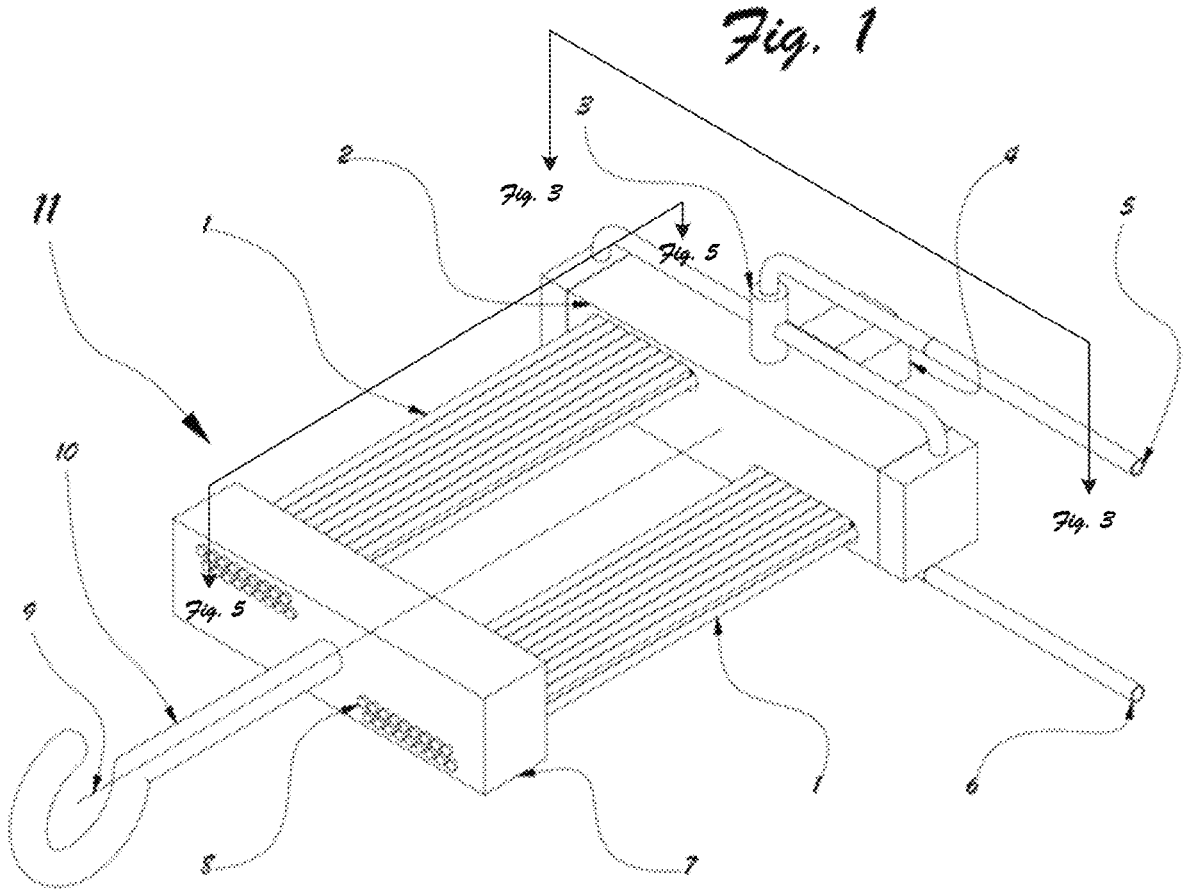
FIG. 1 depicts an isometric view of an embodiment of a variable recruitment actuator consistent with embodiments of the present disclosure.
FIG. 3 depicts a section view of an embodiment of a housing of the variable recruitment actuator of FIG. 1 and depicts the workings of the variable recruitment mechanism consistent with embodiments of the present disclosure.
FIG. 5 depicts a section view of an individual actuator to the variable recruitment mechanism consistent with embodiments of the present disclosure.

Mobile robotic systems and active prosthetic devices may make use of electric motors coupled to high-speed reduction transmissions to drive a joint; however, such systems are typically heavy relative to their maximum power outputs. The inventors of the present disclosure have recognized that hydraulic actuators are capable of relatively high power while weighing less than a system driven by electric powers coupled to high-speed reduction transmissions.

While hydraulic actuators provide power density benefits, a hydraulic system comprising multiple actuators and a single hydraulic pump may present control difficulties. Throttling valves may be used to control the power output of each actuator in the system; however, throttling valves may lead to low efficiencies, which impedes practical use of such systems in mobile applications that may only have a limited amount of energy storage in a battery.

To improve the efficiency of such a hydraulic system, some have tried to control the power outputs of the actuators in a variety of different ways. One solution is to provide a variable displacement pump to power each actuator in a system, but the increased complexity of this solution prevents it from being practical for use in many systems.

In various embodiments consistent with the present disclosure, a system may include a variable recruitment actuator comprising a number of individual actuators that may be recruited (or pressurized) to deliver power to a load. The individual actuators may be attached to mounting points of the variable recruitment actuator. Such an actuator may provide variable recruitment without the complexity of including a variable displacement pump to power each actuator. Systems consistent with the present disclosure may also be able to accurately provide a desired amount of power to each of the variable recruitment actuators, regardless of changes in parameters including but not limited to: load conditions, operating temperatures, and working fluid selection. Systems consistent with the present disclosure may also provide efficient and controllable regenerative braking when paired with a hydraulic accumulator.

Systems consistent with the present disclosure may be applied in a variety of applications, including control of a prosthesis or control of an exoskeleton. In other embodiments, systems consistent with the present disclosure may be used in connection with heavy equipment and a variety of industrial applications.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

A number of techniques and steps are disclosed in connection with various embodiments. Each of these has individual benefits and each can also be used in conjunction with one or more, or in some cases all, of the other disclosed techniques. Accordingly, for the sake of clarity, this description does not repeat every possible combination of the individual steps. Nevertheless, the specification and claims should be read with the understanding that such combinations are within the scope of the invention and the claim.

The present disclosure is to be considered as an exemplification of specific embodiments, and is not intended to limit the claims as understood by one of skill in the art.

FIG. 1 depicts an isometric view of an embodiment of a variable recruitment actuator consistent with embodiments of the present disclosure. The variable recruitment actuator 11 includes a plurality of actuators 1 affixed to a housing 2. Housing 2 comprises the internal components that implement variable recruitment. Depending on the desired behavior from the variable recruitment actuator 11, each of the plurality of actuators 1 may either be recruited or remain inactive. The number of individual actuators recruited determines the force output by the variable recruitment actuator system 11 relative to the supplied pressure. For example, if the number of actuators 1 recruited is doubled, the amount of force output by the variable recruitment actuator system 11 for a given pressure input is also doubled.

The ability to vary the number of actuators 1 recruited provides multiple benefits. For example, the variable recruitment actuator 11 can alter its recruitment level to ensure that a pump powering the variable recruitment actuator 11 operates efficiently. For example, if a hydraulic pump achieves its peak efficiency when it provides a pressure of 1000 psi, the variable recruitment actuator 11 can alter its recruitment level, based on the load applied, to maintain the pressure near 1000 psi. Another benefit of this behavior is that the individual power outputs of a number of variable recruitment actuators can be controlled by varying their recruitment levels. Still further, efficient and highly-controllable regenerative braking may be provided. For example, the fluid flowing outward from an actuator providing a controlled eccentric movement can be used to charge a hydraulic accumulator. As the accumulator builds pressure while charging, fewer muscles can be recruited to provide an approximately constant braking force The actuators 1 are attached to a mounting block 7 that may be connected to a load (not shown), either directly or indirectly. The mounting block 7 may be connected to the load via a hook 10, or a variety of types of connections or fasteners. The actuators 1 may be implemented in some embodiments as McKibben muscles, which are discussed in greater detail below. In other embodiments, the actuators 1 may be embodied using other types of hydraulic actuators.

A high-pressure fluid connection 6 may supply high-pressure fluid to the variable recruitment actuator 11. A low-pressure reference connection 5 may be provided in some embodiments. The low-pressure reference connection 5 may be connected to a storage tank for hydraulic fluid (not shown). In some embodiments, a reservoir pressurized to a level above atmospheric pressure but significantly less than the pressure of the recruited actuators may be provided. The low-pressure reference connection 5 may allow fluid to be drawn into the plurality of actuators 1 that are not being recruited when power is being delivered to a load via a check valve assembly 3. The mounting block 7 may include removable plugs or valves 8 that can be used to remove air from the system during initial construction or maintenance.

As discussed in greater detail below, a motor 4 may be used to control which actuators 1 are recruited. The motor 4 may arrange components disposed in housing 2 to selectively recruit a subset of the plurality of actuators 1. Motor 4 may be connected to a control system (not shown).

In various embodiments, the plurality of actuators 1, as well as the internal components located within the housing 2, may be arranged symmetrically around a centerline 9 to centralize the forces around and prevent sideloading on the hook 10, regardless of the recruitment level of the variable recruitment actuator 11. In one specific embodiment, if half of the plurality of actuators 1 are recruited, the recruited actuators are those closest to the centerline 9 in a rotational symmetry about said centerline 9.

Figure 2:
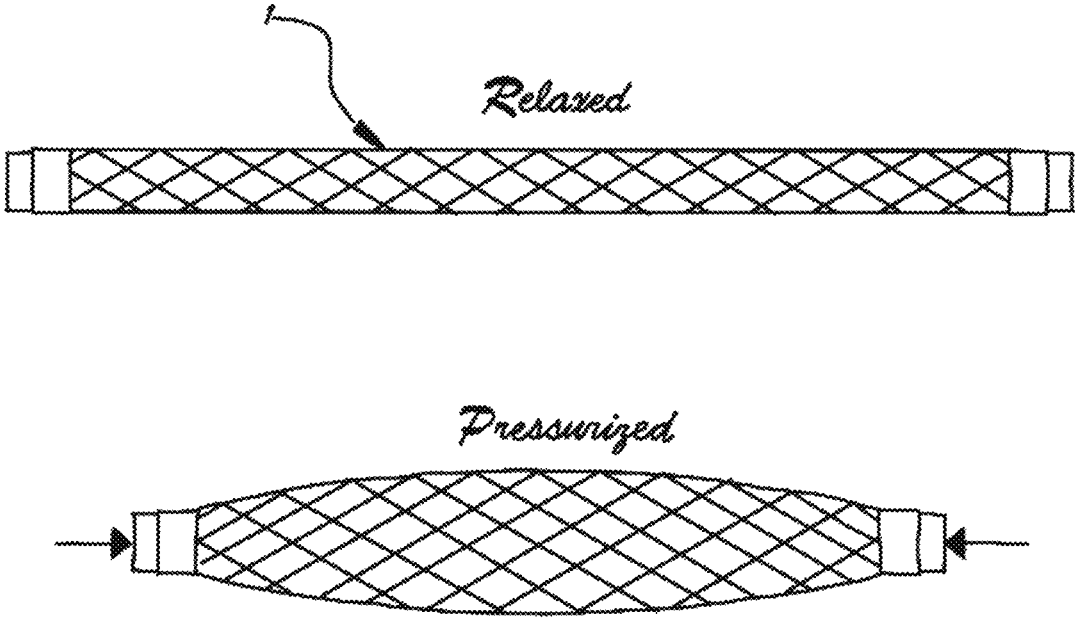
FIG. 2 depicts a McKibben Muscle, which is a type of actuator that may be used for individual actuators in various embodiments consistent with the present disclosure.
Figure 3:
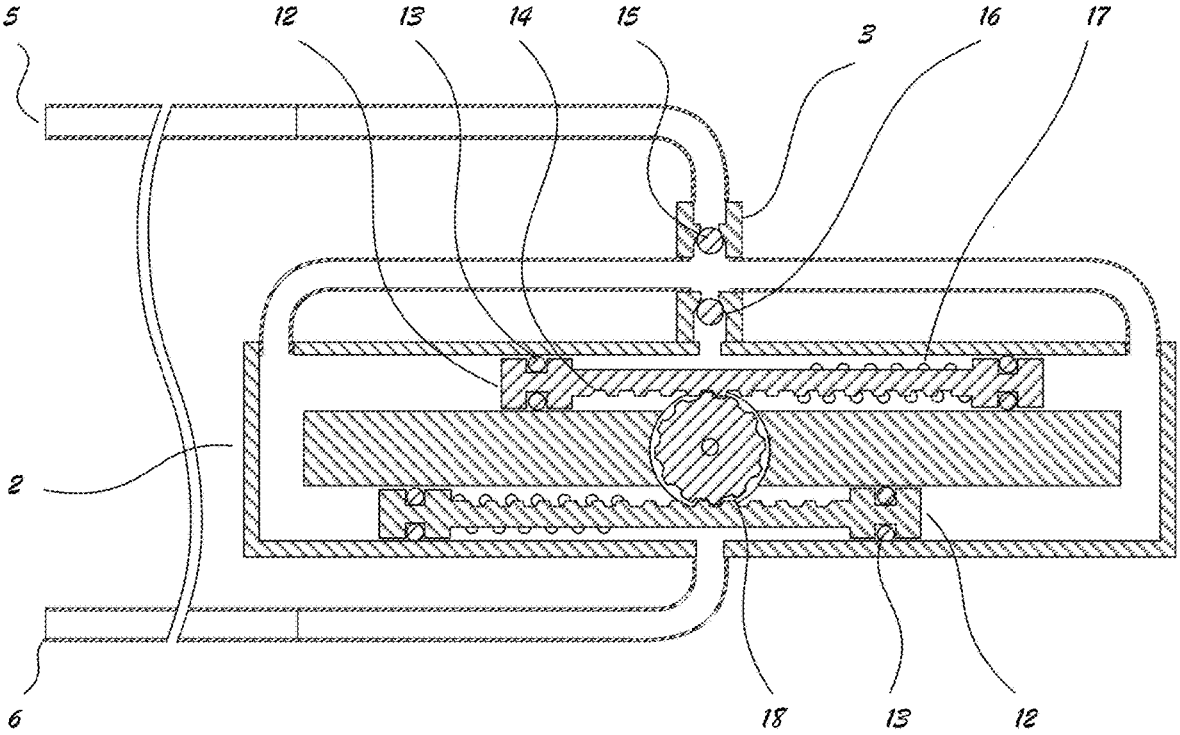

FIG. 2 depicts a McKibben Muscle, a type of actuator that may be used for the individual actuators in the variable recruitment actuator of FIG. 1, consistent with embodiments of the present disclosure. As illustrated, in a relaxed configuration the actuator 1 may have a first length. When the actuator 1 is pressurized the actuator 1 expands radially and contracts in length. In some embodiments, other types of actuators (e.g., hydraulic actuators) may be used.

FIG. 3 depicts a section view of the housing 2 of the variable recruitment actuator of FIG. 1 consistent with embodiments of the present disclosure. Various embodiments consistent with the present disclosure may include a variety of variable recruitment mechanisms to recruit a subset of actuators. In FIG. 3 the variable recruitment mechanism 12 comprises a set of sliding pistons. Variable recruitment mechanism 12 selectively recruits a subset of a plurality of actuators by placing an associated inlet 17 in fluid communication with either a high-pressure fluid connection 6 or a low-pressure reference 5. An individual actuator is recruited by variable recruitment mechanism 12 such that the inlet 17 of the individual actuator is hydraulically connected to the high-pressure source. In contrast, if the position of the variable recruitment mechanism 12 is such that the inlet 17 of a given actuator 1 is connected to the low-pressure reference 5, then the actuator is not recruited and will instead draw in fluid from the low-pressure reference 5. Seals 13 disposed on the variable recruitment mechanism 12 may prevent or reduce leakage of high-pressure fluid to the plurality of actuators 1 that have not been recruited when power is delivered to a load.

In the illustrated embodiment, the position of variable recruitment mechanism 12 is determined by center gear 18. Center gear 18 may engage with a plurality of teeth 14 disposed along the length of variable recruitment mechanism 12. Center gear 18 may be coupled to a motor (e.g., motor 4 shown in FIG. 1). In some embodiments, motor 4 may comprise a stepper motor. In other embodiments, variable recruitment mechanism 12 may be moved by a variety of other methods, such as a servo motor, solenoid, or hydraulic or pneumatic actuator.

In one embodiment, check balls 15 and 16 allow a check valve assembly 3 to control the flow of fluid within the housing 2. When a variable recruitment actuator 11 is delivering power to a load, check ball 15 allows the plurality of actuators 1 that are not being recruited to draw in hydraulic fluid from the low-pressure reference 5. Check ball 15 may be disposed within check valve assembly 3. Check ball 16 prevents high-pressure fluid from high-pressure fluid connection 6 from flowing into the plurality of actuators 1 that have been blocked by variable recruitment mechanism 12. Check valve assembly 3 may also comprise check ball 16. When the variable recruitment actuator 11 is relaxed, and fluid is forced outwards from each of the plurality of actuators 1 (regardless of whether they had been recruited or not) check ball 16 allows fluid from the non-recruited actuators 1 to flow to the high-pressure fluid connection 6. A rate of relaxation may be controlled by throttling the flow out of the variable recruitment actuator 11. When the variable recruitment actuator 11 is relaxed, check ball 15 prevents fluid from back-flowing to the low-pressure reference 5. In a system using regenerative braking, check ball 15 may be removed from check valve assembly 3 to allow for variable recruitment during eccentric movements.

Figure 4:
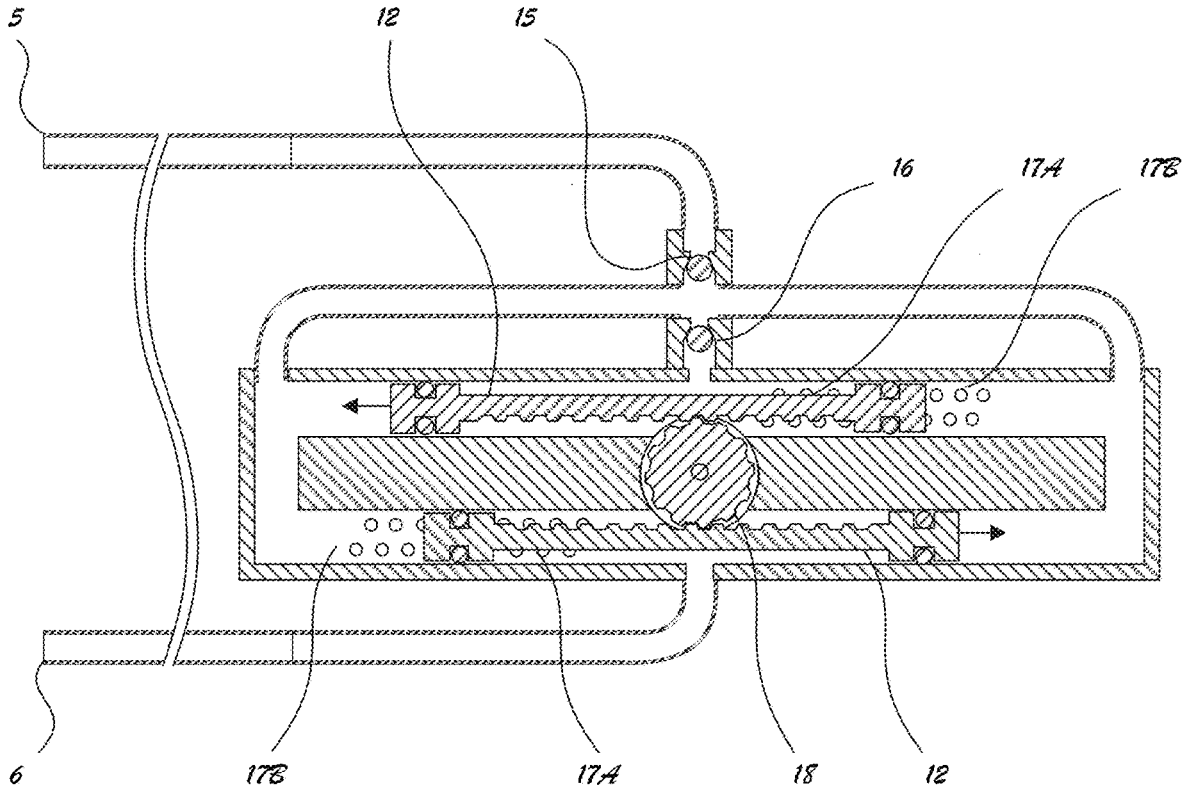
FIG. 4 depicts the movement of the components shown in FIG. 3 when the variable recruitment actuator is used to deliver power to a load consistent with embodiments of the present disclosure.
Figure 5:
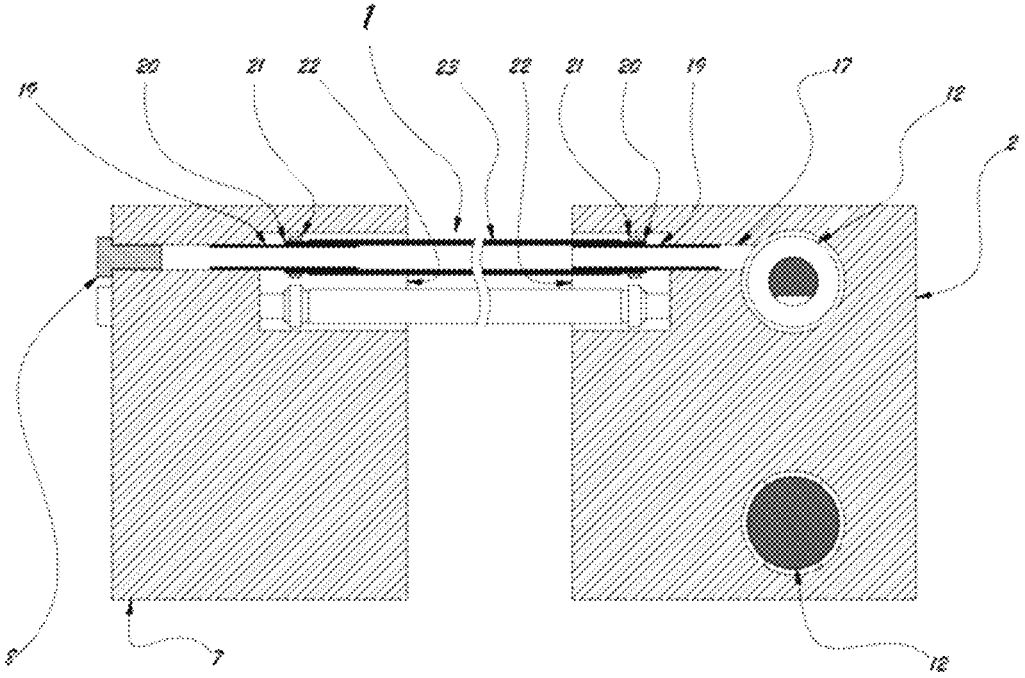

FIG. 4 depicts the movement of the components shown in FIG. 3 when the variable recruitment actuator is used to deliver power to a load consistent with embodiments of the present disclosure. To provide a constant power output to the load, the variable recruitment actuator of FIG. 3 may provide less force as the load gains speed. Reduced force may be achieved by decreasing the number of recruited actuators of FIG. 1. This is achieved by rotating the center gear 18 counterclockwise, moving the upper portion of variable recruitment mechanism 12 to the left and the lower portion of variable recruitment mechanism 12 to the right.

In the configuration illustrated in FIG. 4, inlets 17B are connected to the low-pressure reference 5, and the associated actuators are not being pressurized. Additionally, inlets 17B draw fluid inward from the low-pressure reference 5 because the check ball 15 becomes unseated and allows fluid to flow. Check ball 16 prevents pressurized fluid from leaking to the inlets 17B of the plurality of actuators 1 not being recruited. Inlets 17A are connected to high-pressure fluid connection 6. The connection to the high-pressure fluid connection 6 results in the recruitment of the actuators associated with inlets 17A. The rotational symmetry of the internal components illustrated in FIG. 4 results in the forces acting through the centerline of FIG. 1 regardless of the total number of actuators recruited.

When the variable recruitment actuator is relaxed, fluid flows from both the recruited and non-recruited actuators to the high-pressure connection 6 when check ball 15 is used in the check valve assembly 3. Fluid from the non-recruited actuators flows through check ball 16, which becomes unseated and allows fluid to flow past. The outward flow to the high-pressure fluid connection 6 may be throttled to control the rate of relaxation of the variable recruitment actuator. In a system designed for regenerative braking, the rate of relaxation may be controlled by the recruitment level of the actuator. Additionally, the control valve connected to the check valve assembly 3 may prevent flow entirely, locking the position of the variable recruitment actuator.

FIG. 5 depicts a section view of an individual actuator 1 to a variable recruitment mechanism consistent with embodiments of the present disclosure. Among other things, FIG. 5 illustrates how actuators 1 are sealed and held in place. In the illustrated embodiment, the plurality of actuators 1 are embodied as McKibben muscles.

A rigid tube 19 may be used to connect an elastic member 20 of the McKibben Muscle to an inlet 17 of the actuators 1. The elastic member 20 may be connected to the tube 19 via a crimp or swaged fitting 21. In some embodiments, the crimp fitting 21 may be crimped over an outer braided sleeve 23 in addition to the elastic member 20. In some embodiments, cavities 22 on a surface of a mounting block 7 and a housing 2 are filled with an epoxy adhesive to aid with sealing and to secure the individual actuators 1 to the housing 2 and to the mounting block 7. The outer braided sleeve 23 may be disposed along a length of the actuators 1.

Figure 6:
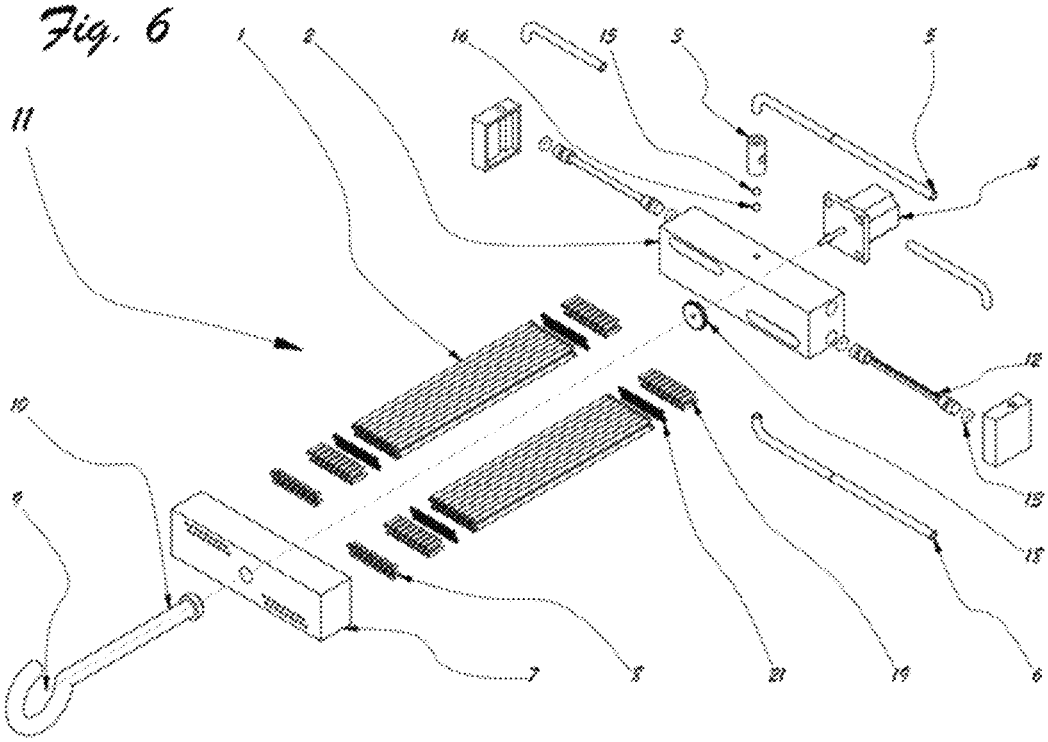
FIG. 6 depicts an exploded isometric view of an embodiment of the variable recruitment actuator of FIG. 1 consistent with embodiments of the present disclosure.

FIG. 6 depicts an exploded isometric view of an embodiment of the variable recruitment actuator of FIG. 1 consistent with embodiments of the present disclosure.

Figure 7:
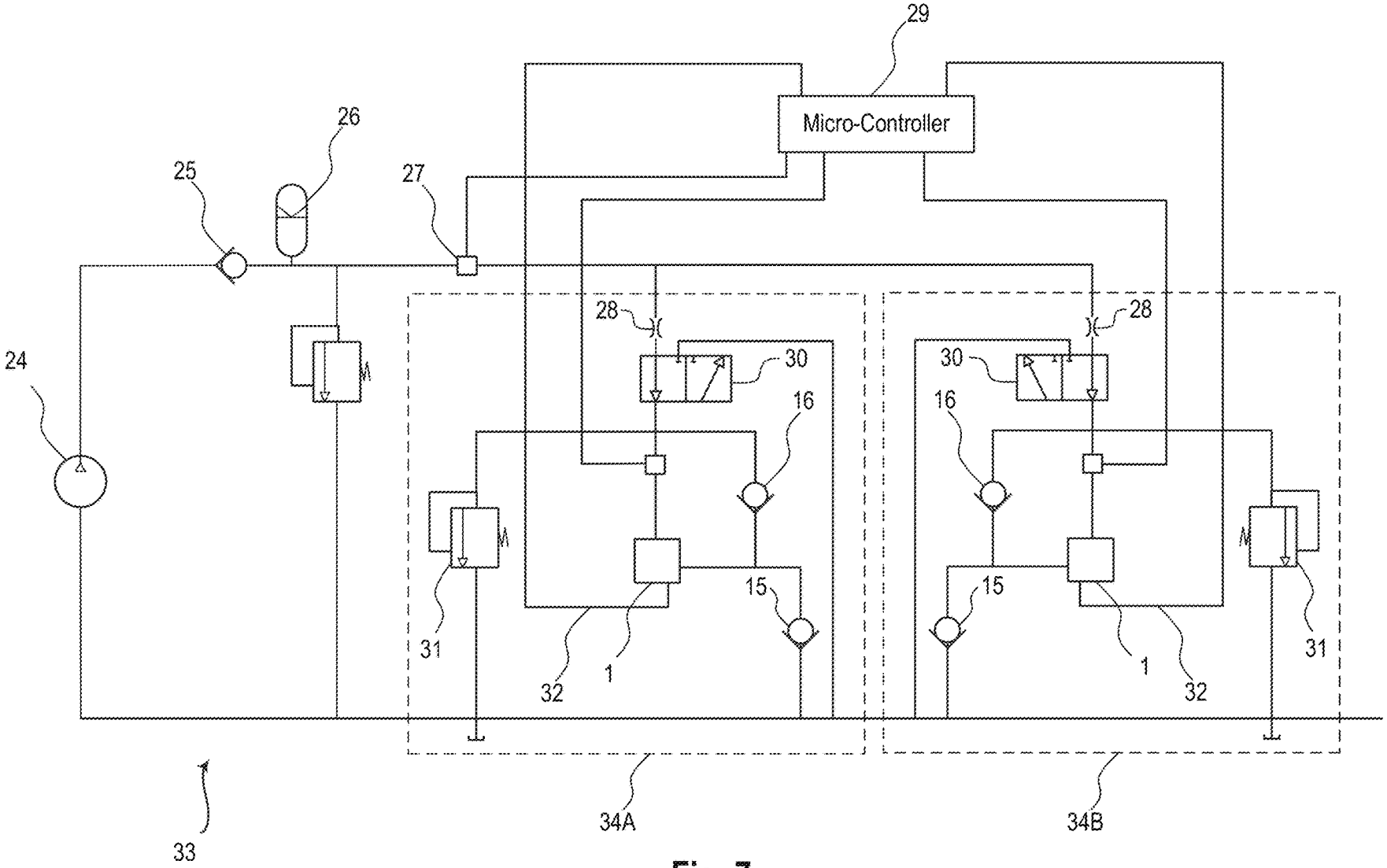
FIG. 7 is a schematic diagram of a hydraulic system comprising a plurality of variable recruitment actuators consistent with embodiments of the present disclosure.

FIG. 7 is a schematic diagram of a hydraulic system 33 using multiple variable recruitment actuators consistent with embodiments of the present disclosure. A microcontroller 29 may vary recruitment of a plurality of actuators to control a power output regardless of the load applied to the actuators. Flow restrictor 28 may create a pressure differential between an output of a pump 24 and an inlet to each of a plurality of variable recruitment actuators 1. However, the flow restrictor 28 may be moderate such that only a proportionally small drop in pressure occurs. For each of the variable recruitment actuators 1, the pressure differential across the associated flow restrictor 28 can be used to determine the relative power output of each of the actuators, as explained in the detailed description of FIG. 8. To determine the pressure differentials, pressure sensors 27 are used to monitor the pressure output from the pump 24 as well as the pressures within the plurality of variable recruitment actuators 1.

A microcontroller 29 is used to monitor the pressures within the system 33 to control the recruitment mechanisms within each of the variable recruitment actuators and to control each of a plurality of control valves 30. The microcontroller 29 provides a signal 32 to a recruitment mechanism in each of the plurality of variable recruitment actuators 1. For example, if the recruitment mechanism is a stepper motor, then the signal may alter the rotational position of the stepper motor. If the recruitment mechanism is a hydraulic piston, the signal may be used to control a valve that extends or retracts the piston.

Control valves 30 may be used to supply each of the variable recruitment actuators with pressurized fluid, prevent fluid from flowing into or out of the variable recruitment actuator, locking it in place, or to drain the fluid in the variable recruitment actuator to a low-pressure reference, allowing the actuators to relax. In some embodiments, the control valves 30 can be used to throttle the flow out of the actuators, slowing its rate of relaxation.

Pressure-relief valves 31 may be included to prevent the system 33 from becoming over-pressurized. In the illustrated embodiment, an accumulator 26 may be used to smooth pressure pulsations from the pump 24 and a check valve 25 may be used to protect the pump 24. In some embodiments, the accumulator 26 may also be used to store energy during regenerative braking. Check balls 15 and 16 may control the flow of hydraulic fluid between high-pressure and low-pressure connections.

Hydraulic system 33 includes a first subsystem 34A and a second subsystem 34B. Subsystems 34A and 34B represent two separate variable recruitment actuators that may be used to power two separate joints. The behavior of either of these actuators may be controlled via changes to their respective recruitment levels and via throttling from an associated control valve 30.

Figure 8:
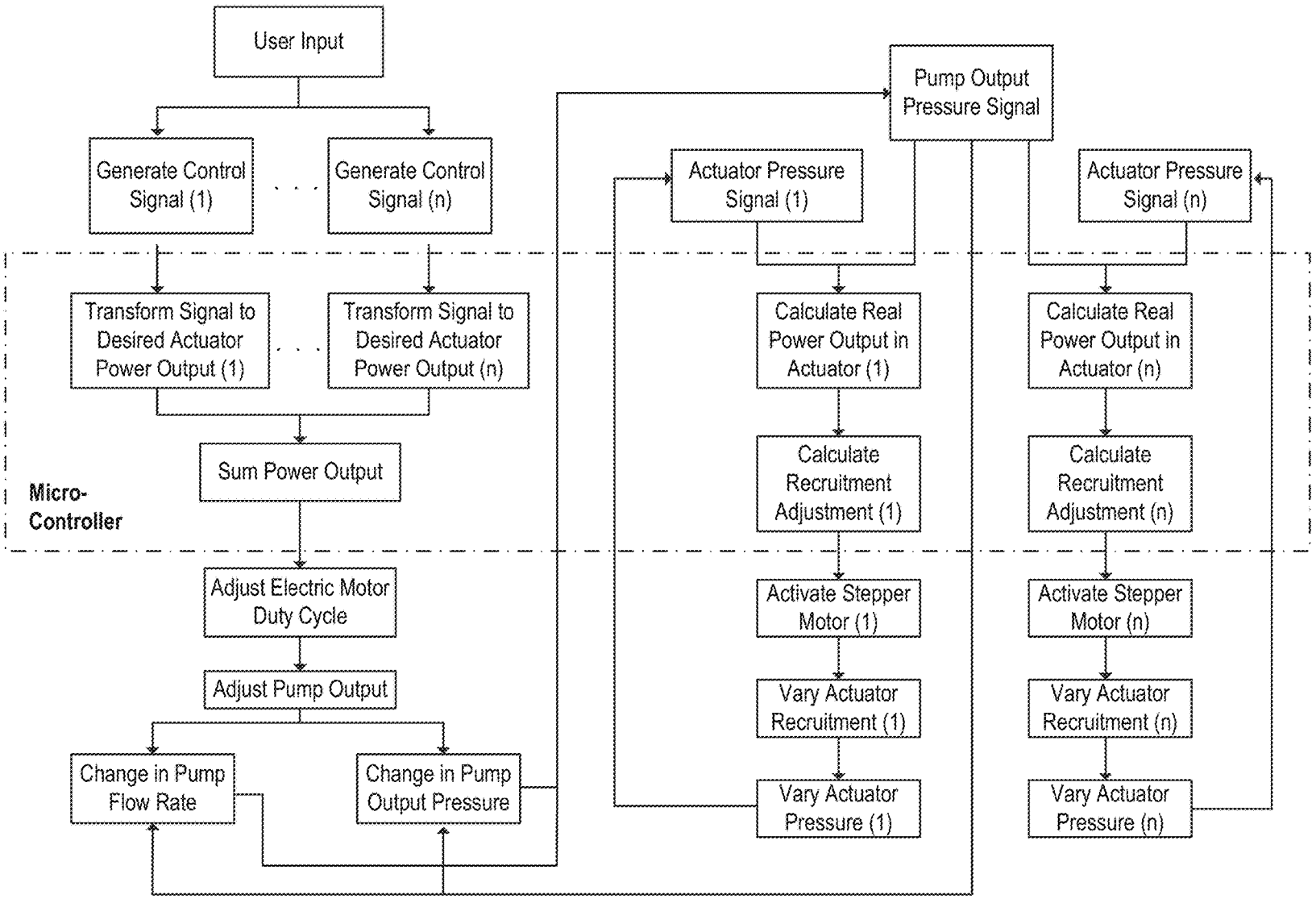
FIG. 8 is a block diagram of a control strategy for a variable recruitment actuator system consistent with embodiments of the present disclosure.

FIG. 8 is a block diagram of a control strategy for a variable recruitment actuator system consistent with embodiments of the present disclosure. FIG. 8 may represent an embodiment of the logic used to control the recruitment of each of a plurality of actuators of a hydraulic system, such as hydraulic system 33 illustrated in FIG. 7.

User input may be received and used to generate control signals for a plurality of individual subsystems, each of which may be used to control a plurality of actuators. Each of the plurality of actuators may be controlled separately, and a separate control signal may be generated for each of the plurality of subsystems (n). The control signal may be transformed into a set of desired power outputs. The sum of the power output of each of the plurality of subsystems may be determined. In some embodiments, the total power output may be used to adjust a pump output and/or a pump flow rate. The adjustment may determine a required duty cycle of an electric motor used to power a hydraulic pump.

Once the pump begins to pressurize the hydraulic system, a pump output pressure signal may be collected by a microcontroller. A pressure differential across a flow restrictor can be correlated to a flow rate through the flow restrictor. For example, a pressure differential of 100 across a flow restrictor would indicate approximately twice the flow rate when compared to the same flow restrictor with a pressure differential of 50 psi, so long as the flow is nearly laminar and the working fluid is approximately Newtonian. This behavior can be used to determine the power outputs of each of a plurality subsystems in an associated variable recruitment actuator system, even if the exact resistance to the fluid flow is unknown.

For example, if the flow restrictor associated with variable recruitment actuator "1" has a pressure differential of 50 psi, the flow restrictor associated with variable recruitment actuator "n" has a pressure differential of 5 psi, both of the flow restrictors are the same, that is, they produce the same pressure differential per amount of flow through the restrictor, and each of the flows are nearly laminar and the working fluid is approximately Newtonian, then actuator "1" would be outputting approximately 10 times the power output relative to actuator "n" if the internal pressure of the actuators are nearly equivalent. If the total power output of the system is approximated based on the duty cycle applied to the electric motor, an approximation for the power outputs of both actuator "1" and actuator "n" can easily be calculated. The approximation would be fairly accurate, so long as the efficiency of the system remains high. To improve the accuracy of this calculation, correction factors based on one or more parameters such as total power output, fluid temperature, pump pressure output, motor speed, or other parameters can be used.

Once the power outputs of each of the variable recruitment actuators are known, their recruitment levels can be adjusted as needed. To reduce the relative power output, a recruitment level may be lowered, raising the pressure required to move a given load, diverting more of the flow of hydraulic fluid to other actuators in the system. The opposite is also true, if the relative power output may be increased. As the recruitment level is increased, the pressure required to move a given load may be reduced and more flow may be drawn in from the rest of the system.

To ensure accurate power outputs of a system and the efficient performance of a coupled hydraulic motor and pump, the recruitment levels of the variable recruitment actuators could be adjusted as discussed in the following examples.

In one scenario, two variable recruitment actuators are used to deliver power to a load. The desired power outputs of the actuators are 20 watts for variable recruitment actuator "1" and 40 watts for variable recruitment actuator "2". In this example, the optimal pump output pressure for a total power output of 60 watts is based on the efficiency curve of the pump. The microcontroller takes readings on the performance of the system and determines actuator "1" is delivering 10 watts of power, actuator "2" is delivering 50 watts of power, and the pump's output pressure is too low, which may indicate excessive viscous friction efficiency losses. To correct the behavior of the system, the microcontroller can reduce the recruitment level of "2" to reduce its power output. This would simultaneously increase the power output of "1" and raise the pump's output pressure. This microcontroller may use a proportional-integral-derivative (PID) controller to alter the performance of the system, iteratively reducing the error in the output pressure of the pump and the error in the power outputs of the variable recruitment actuators.

In another scenario, the same two variable recruitment actuators and pump are used to deliver power to a load. The desired and actual power outputs of the actuators are the same. However, the microcontroller takes readings on the performance of the system and determines that the pump's output pressure is too high, which may indicate excessive electrical resistive losses in the motor that drives the pump i. In this scenario, the microcontroller could instead increase the recruitment level of variable recruitment actuator "1", which would simultaneously increase the power output of "1" and lower the pump's output pressure. Once again, the errors in the power outputs of the variable recruitment actuators and the error in the pump's output pressure may be reduced iteratively using a PID controller.

In both of the previous scenarios, the microcontroller adjusts the recruitment levels of individual variable recruitment actuators to help ensure accurate power delivery and the efficient performance of the hydraulic pump powering the system. While there are other scenarios that a system using variable recruitment actuators could encounter, the overall goals of the microcontroller would remain the same.

In one specific embodiment involving a stepper motor used to recruit a plurality of actuators (e.g., the variable recruitment actuator 11 illustrated in FIG. 1), the recruitments may be altered through the rotation of a number of stepper motors. The change caused by activator of the stepper motor may vary actuator requirement and may vary actuator pressure. The change in pressure may be fed back to control system through the change in the actuator pressure signal.

Figure 9:
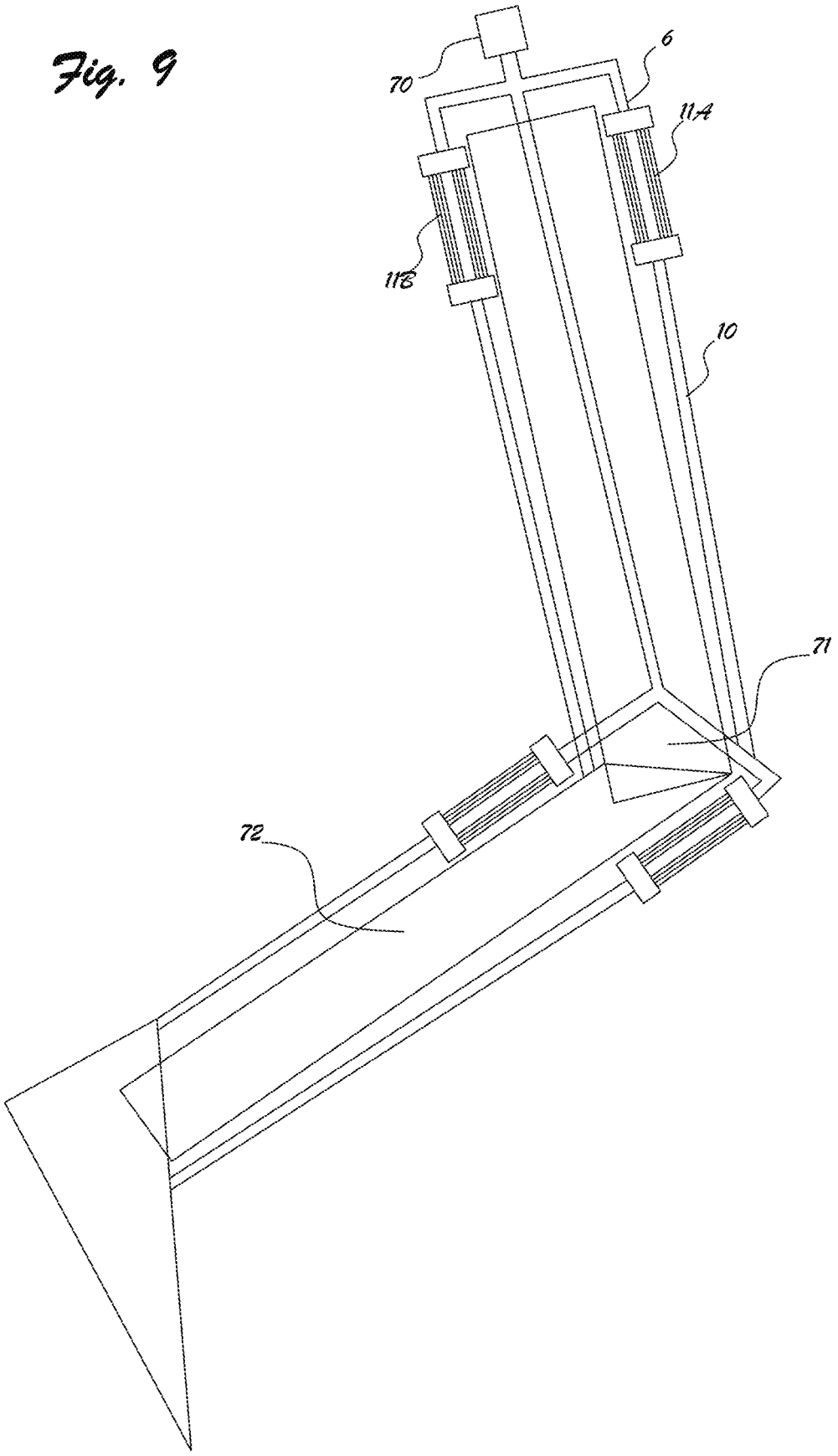
FIG. 9 depicts a prosthetic device comprising a plurality of variable recruitment actuators consistent with embodiments of the present disclosure.

FIG. 9 depicts a prosthetic device comprising a plurality of variable recruitment actuators consistent with embodiments of the present disclosure. In the illustrated embodiment, a prosthetic device that is powered by a plurality of variable recruitment actuators using a single pump 70 is provided. The lower portion 72 of the prosthetic is rotated about a joint 71 by two antagonistic variable recruitment actuators 11A and 11B. A plurality of connections may be coupled to a corresponding plurality of mounting points. High-pressure fluid connections 6 hydraulically couple all of the variable recruitment actuators 11A, 11B to the pump 70. Many of the hydraulic components shown in FIG. 7 are not depicted in this simplified diagram.

Figure 10:
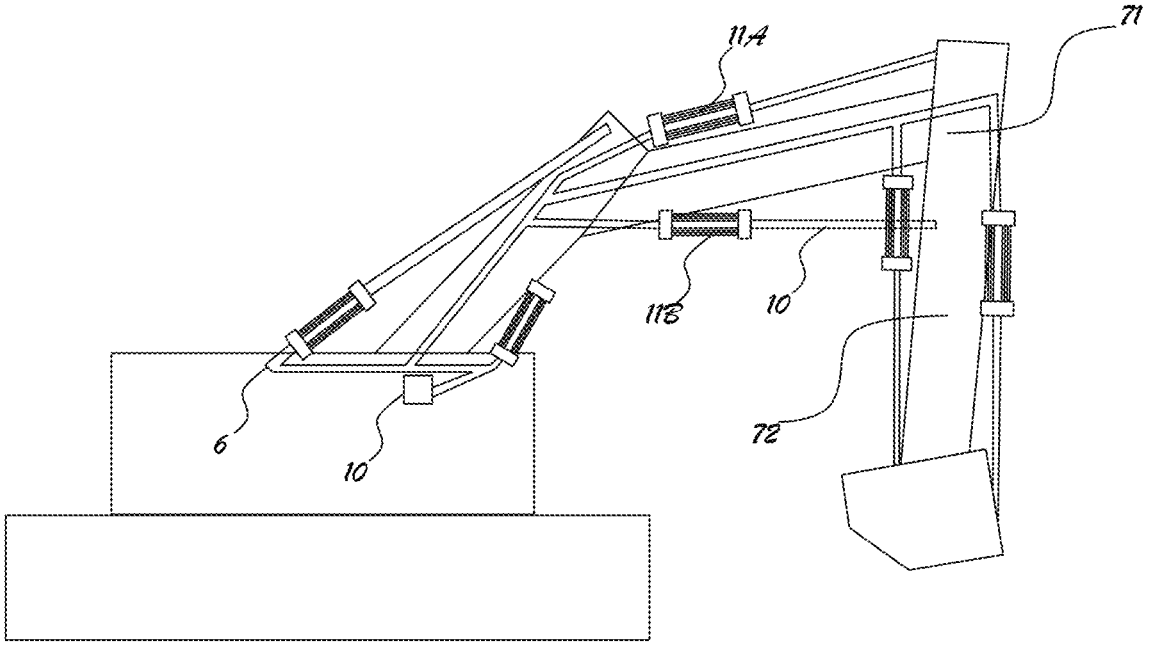
FIG. 10 depicts an excavator comprising a plurality of variable recruitment actuators consistent with embodiments of the present disclosure.

FIG. 10 depicts an excavator comprising a plurality of variable recruitment actuators 11A, 11B consistent with embodiments of the present disclosure. A portion of a boom is articulated about the joint 71 by the two variable recruitment actuators 11A and 11B. Connections 10 are used to connect to mounting points on a lower portion 72. Many of the hydraulic components shown in FIG. 7 are not depicted in this simplified diagram.

Figure 11:
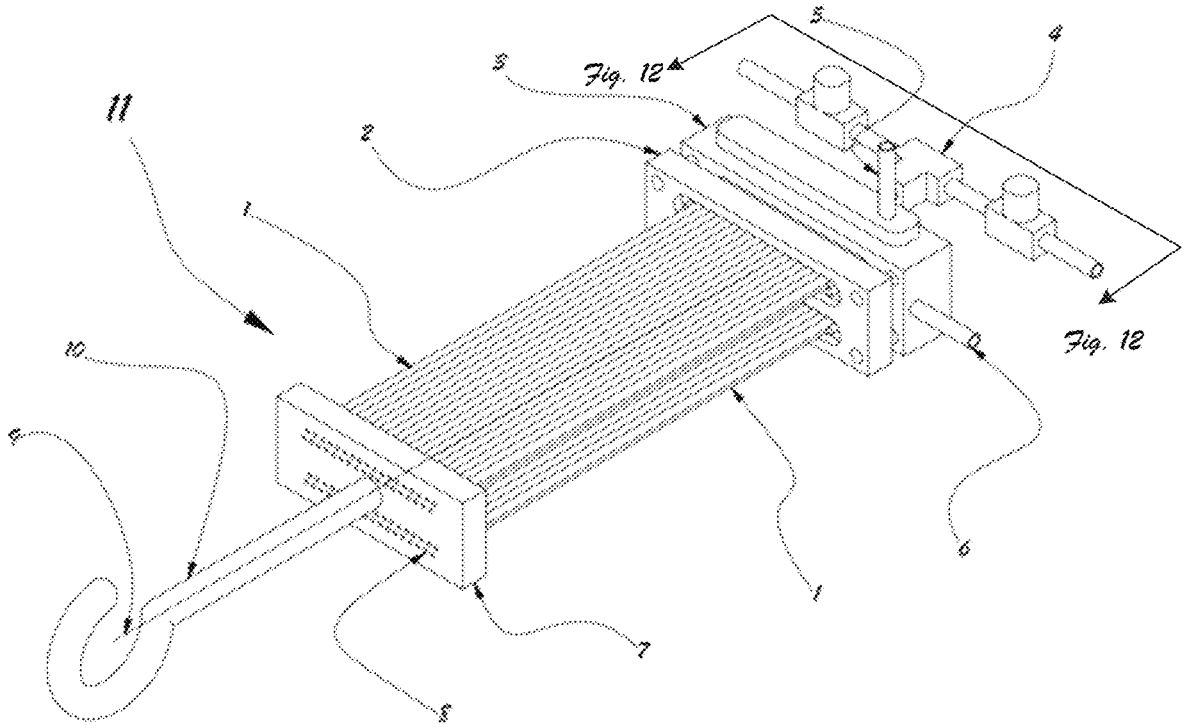
FIG. 11 depicts an isometric view of a variable recruitment actuator consistent with embodiments of the present disclosure.

FIG. 11 depicts an isometric view of a variable recruitment actuator consistent with embodiments of the present disclosure. A plurality of actuators 1 may be disposed between a housing 2 and a mounting block 7. Each of the plurality of actuators 1 may include removable plugs or valves 8 that can be used to remove air from the system during initial construction or maintenance. A housing 2 may comprise a recruitment mechanism to selectively recruit a subset of the plurality of actuators 1. The recruitment mechanism may place certain of the actuators 1 in fluid communication with either a high-pressure fluid connection 6 or a low-pressure reference 5. The plurality of actuators 1 are disposed symmetrically around a centerline 9. A hook 10 may be used to couple variable recruitment actuator system 11 to another device.

Figure 12:
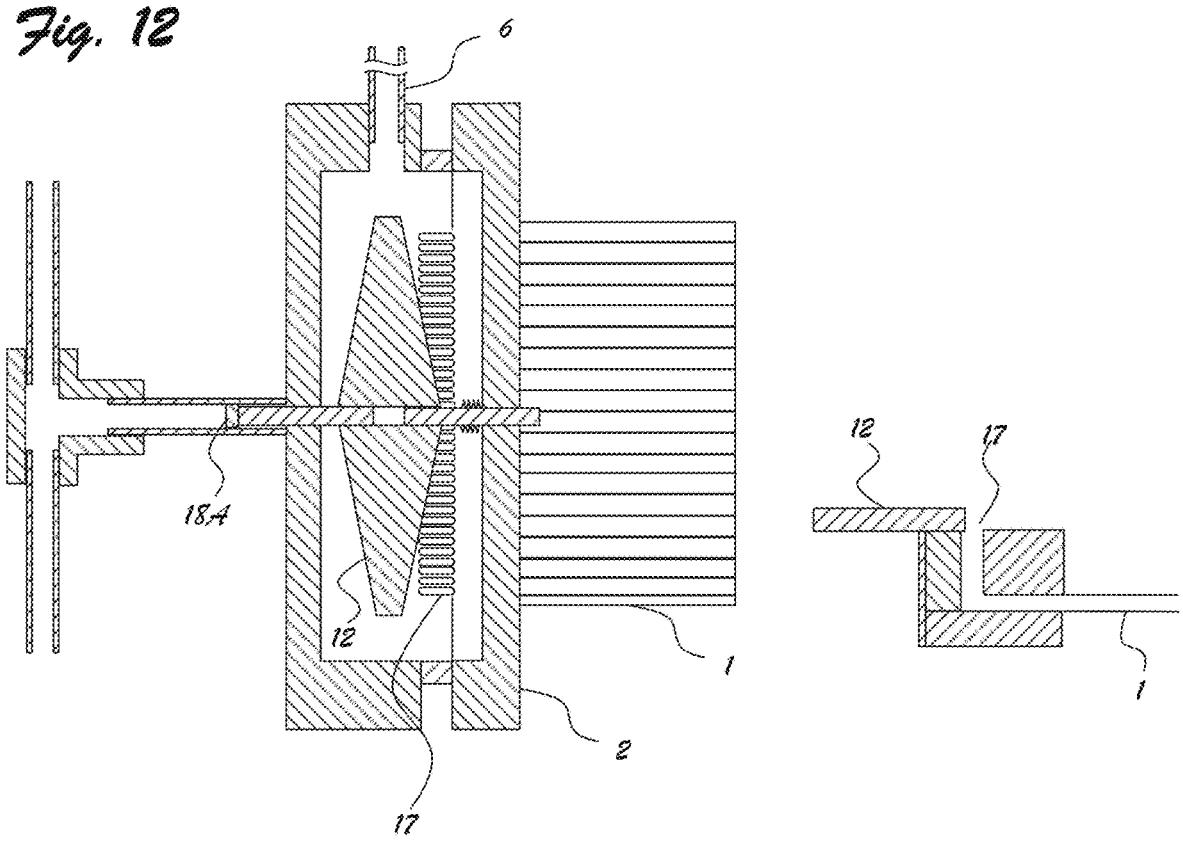
FIG. 12 depicts a section view of a housing of the variable recruitment actuator of FIG. 11 consistent with embodiments of the present disclosure.

FIG. 12 depicts a section view of the housing 2 of the variable recruitment actuator 11 of FIG. 11 consistent with embodiments of the present disclosure. FIG. 12 shows operation of a recruitment mechanism comprising a hydraulic actuator 18A and a variable recruitment mechanism 12. Variable recruitment mechanism 12 is shaped to selectively cover a variable number of inlets 17. Inlets that are not covered by variable recruitment mechanism 12 may be in hydraulic communication with high-pressure pressure fluid connection 6. Actuators 1 in fluid communication with the high-pressure fluid connection 6 are recruited. In contrast, actuators 1 corresponding to an inlet 17 that is sealed by variable recruitment mechanism 12 are not in fluid communication with high-pressure fluid connection 6 and are not recruited. The side view shown in FIG. 12 illustrates that as variable recruitment mechanism 12 moves to the right, a specific inlet 17 may be blocked. Inlet 17 may be in fluid communication with actuator 1, and as such, the position of variable recruitment mechanism 12 establishes whether actuator 1 is recruited.

Figure 13:
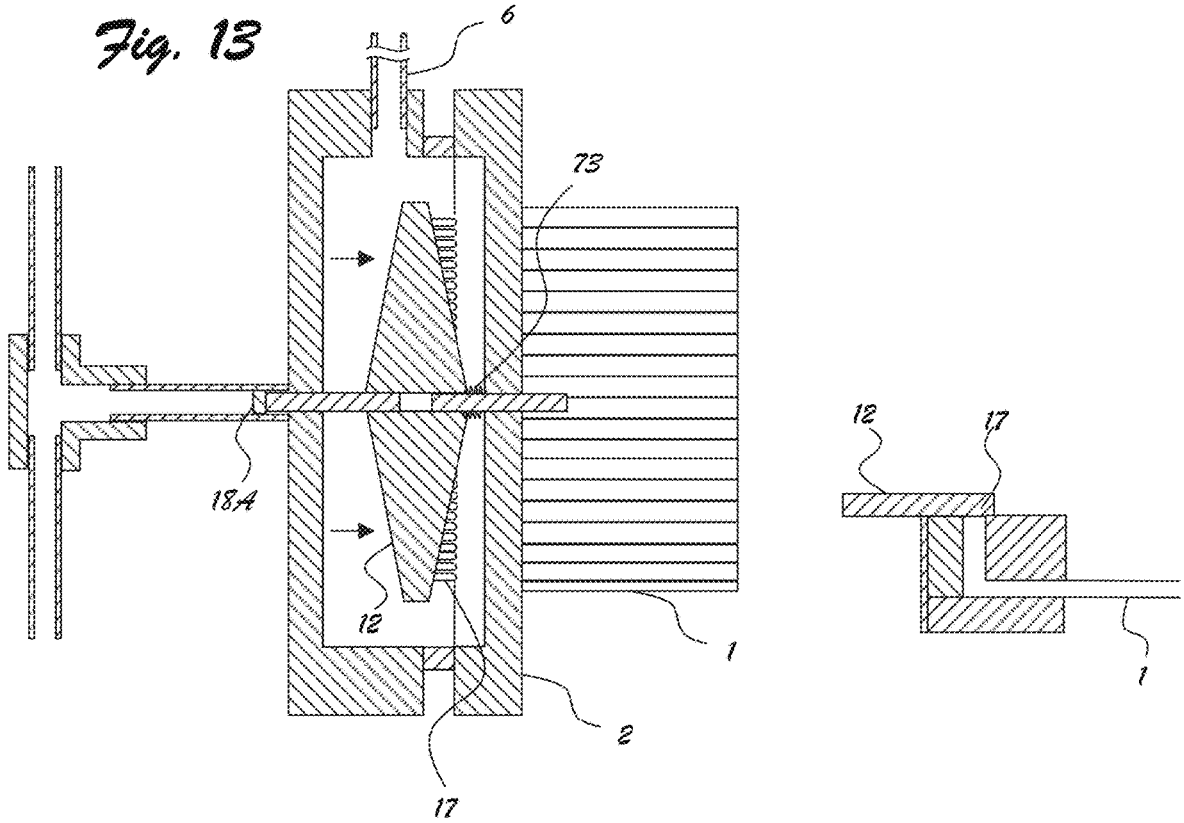
FIG. 13 depicts another section view of the housing of the variable recruitment actuator of FIG. 11 and shows movement of the components with respect to FIG. 12 when the variable recruitment actuator is used to deliver power to a load consistent with embodiments of the present disclosure.

FIG. 13 depicts another section view of the housing 2 of the variable recruitment actuator 11 of FIG. 11 and shows movement of the components with respect to FIG. 12 when the variable recruitment actuator is used to deliver power to a load consistent with embodiments of the present disclosure. As may be seen in comparing the position of the variable recruitment mechanism 12 in FIG. 12 to the position in FIG. 13, certain of a plurality of inlets 17 are covered. Specifically, the side view in FIG. 13 illustrates shows that the position of the variable recruitment mechanism 12 seals inlet 17, and as such, actuator 1 is not recruited. The movement of a variable recruitment mechanism 12 to the right compresses a return spring 73, such that when the pressure is reduced on hydraulic actuator 37, and the variable recruitment mechanism 12 moves to the left.

Figure 14:
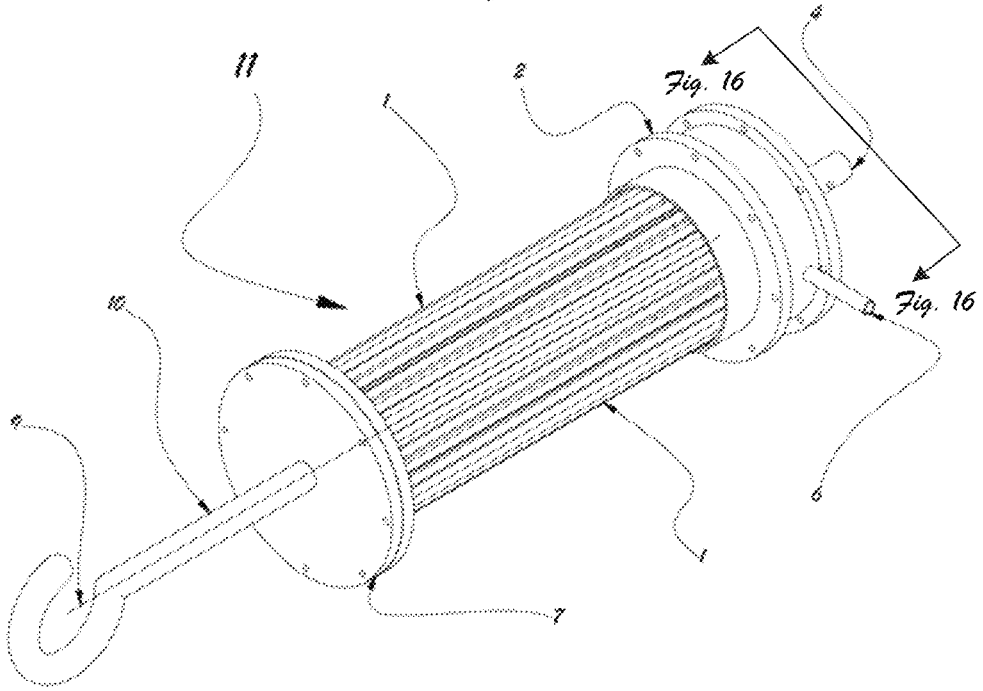
FIG. 14 depicts an isometric view of another embodiment of a variable recruitment actuator consistent with embodiments of the present disclosure.
Figure 15:
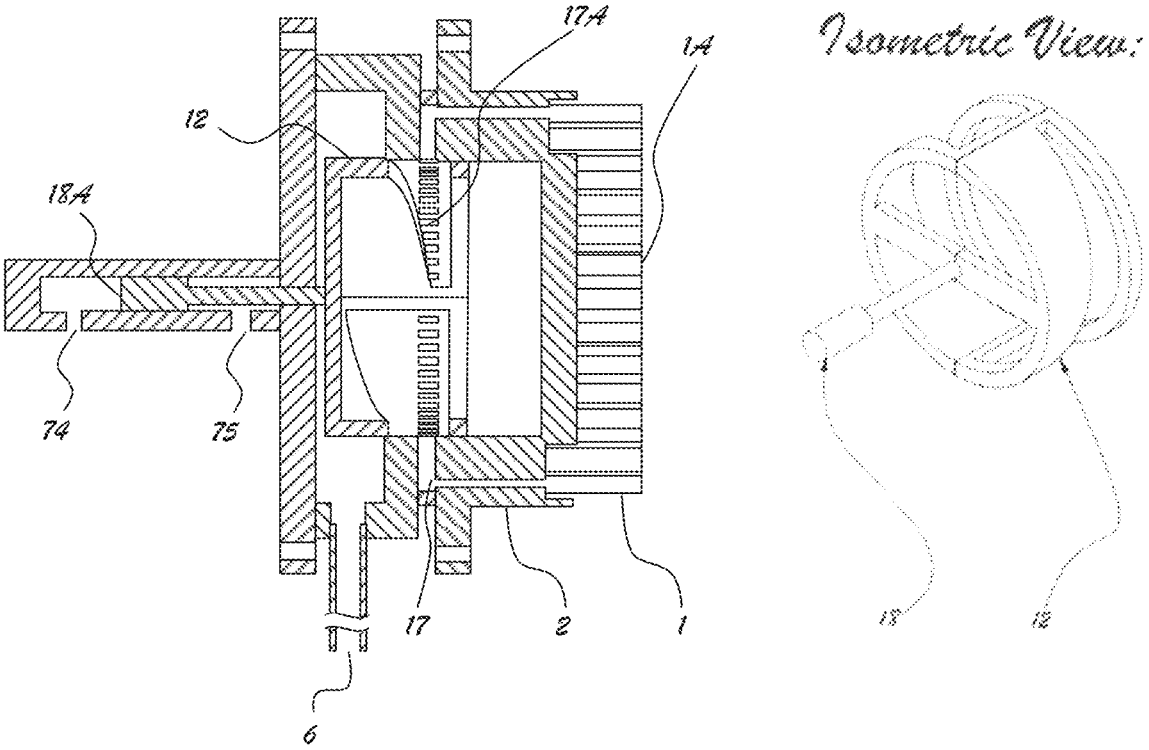
FIG. 15 depicts a section view of the variable recruitment actuator of FIG. 14 consistent with embodiments of the present disclosure.
Figure 16:
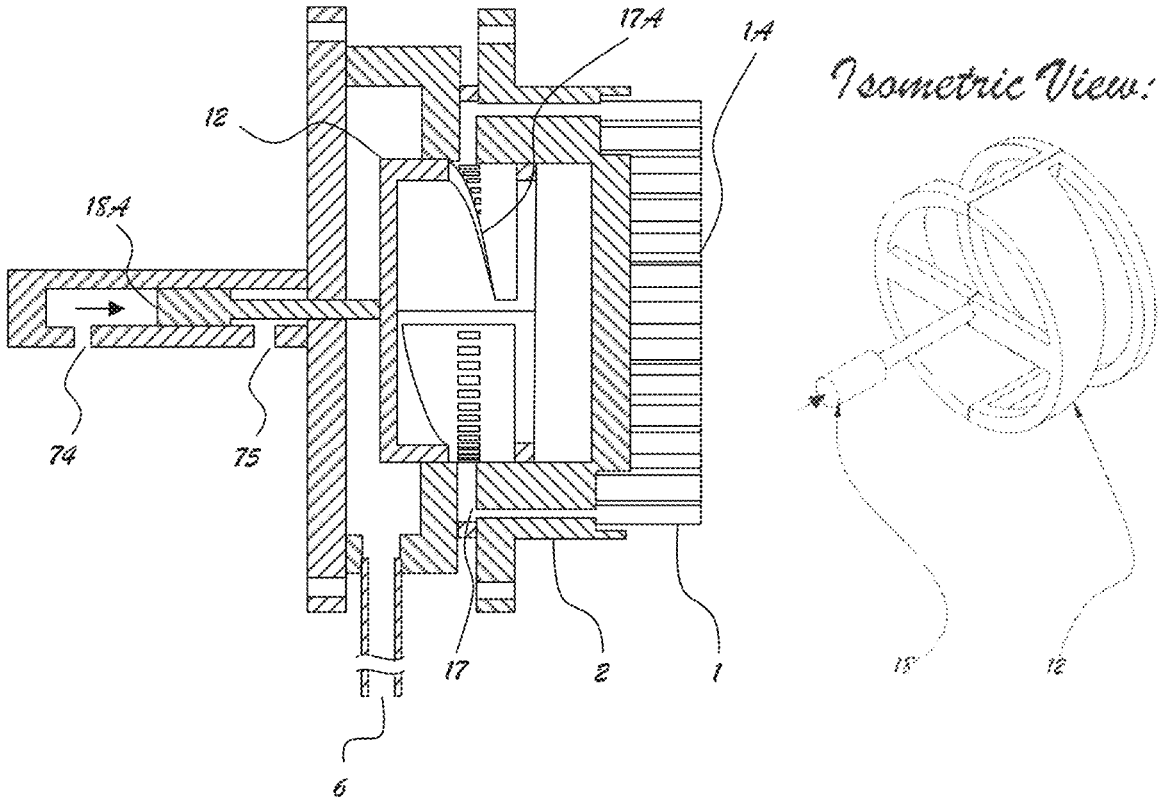
FIG. 16 depicts a section view of the variable recruitment actuator of FIG. 14 and shows movement of the components with respect to FIG. 15 when the variable recruitment actuator is used to deliver power to a load consistent with embodiments of the present disclosure.

FIG. 14 depicts an isometric view of another embodiment of a variable recruitment actuator 11 consistent with embodiments of the present disclosure. A housing 2 includes a variable recruitment mechanism that is illustrated in FIGS. 15 and 16. A high-pressure fluid connection 6 may be in fluid communication with a pump or other source of high-pressure fluid. A plurality of actuators 1 may be disposed between the housing 2 and a mounting block 7. A hook 10 may be used to couple variable recruitment actuator system 11 to another device.

FIG. 15 depicts a section view of the variable recruitment actuator 12 disposed within the housing 2 of FIG. 14 and consistent with embodiments of the present disclosure. As illustrated in FIG. 15, variable recruitment mechanism 12 includes a sloped opening. As variable recruitment mechanism 12 moves from left to right, the sloped opening seals some of a plurality of inlets 17 of the plurality of actuators 1, while leaving some inlets 17 of the plurality of actuators 1 in fluid communication with the high-pressure fluid connection 6.

Variable recruitment mechanism 12 may be positioned using hydraulic actuator 18A. Introducing a pressurized fluid to act on hydraulic actuator 18A through opening 74 may cause the variable recruitment mechanism 12 to move from left to right. Similarly, introducing a pressurized fluid through opening 75 may cause the variable recruitment mechanism 12 to move from right to left.

FIG. 16 depicts a section view of the variable recruitment actuator 12 of FIG. 14 and shows movement of the components with respect to FIG. 15 when the variable recruitment actuator 12 is used to deliver power to a load consistent with embodiments of the present disclosure. As may be seen in comparing FIG. 15 and FIG. 16, movement of the variable recruitment mechanism 12 from left to right changes a number of inlets 17 in fluid communication with high-pressure fluid connection, thus resulting in selective recruitment of a subset of the plurality of actuators 1.

Referring now to FIG. 16, the movements of the components shown in FIG. 15 are depicted when the recruitment level of the actuator needs to be decreased. Variable recruitment actuator 12 moves to the right, blocking off 17A, causing 1A to no longer be recruited. In this example, 18A would need to be supplied with high-pressure fluid.

While specific embodiments and applications of the disclosure have been illustrated and described, it is to be understood that the disclosure is not limited to the precise configurations and components disclosed herein. Accordingly, many changes may be made to the details of the above-described embodiments without departing from the underlying principles of this disclosure. The scope of the present invention should, therefore, be determined only by the following claims.

What is claimed is:

1. A variable recruitment actuator system, comprising:

a high-pressure fluid connection;

a plurality of actuators;

a variable recruitment actuator mechanism to selectively recruit a subset of the plurality of actuators based on a position of the variable recruitment actuator mechanism by selectively placing the subset of the plurality of actuators in fluid communication with the high-pressure fluid connection; and a control system to:

control the position of the variable recruitment actuator mechanism based on an input from a user;

determine a power output based on the input from the user;

use a relative pressure differential of the subset of the plurality of actuators to determine an actual power output; and adjust the position of the variable recruitment actuator mechanism to adjust the subset of the plurality of actuators.

2. The variable recruitment actuator system of claim 1, wherein the plurality of actuators comprise McKibben muscles.

3. The variable recruitment actuator system of claim 1, wherein the variable recruitment actuator mechanism comprises a piston.

4. The variable recruitment actuator system of claim 3, further comprising a motor coupled to the piston such that activation of the motor changes the position of the piston.

5. The variable recruitment actuator system of claim 1, wherein the plurality of actuators are disposed symmetrically about a centerline of the variable recruitment actuator system.

6. The variable recruitment actuator system of claim 1, further comprising at least one hydraulic pump to provide a high-pressure fluid to the high-pressure fluid connection.

7. The variable recruitment actuator system of claim 1, further comprising a housing to which at least one side of each of the plurality of actuators is coupled.

8. The variable recruitment actuator system of claim 1, further comprising:

an electric motor configured to be controlled by the control system; and a gear coupled to the electric motor;

wherein the variable recruitment actuator mechanism comprises a hydraulic piston comprising a plurality of teeth disposed along its length and configured to interact with the gear such that rotation of the gear establishes the position of the hydraulic piston.

9. The variable recruitment actuator system of claim 8, wherein the variable recruitment actuator mechanism comprises a second hydraulic piston.

10. The variable recruitment actuator system of claim 9, wherein the second hydraulic piston comprises a second plurality of teeth disposed along its length and configured to interact with the gear such that rotation of the gear establishes the position of the second hydraulic piston.

11. The variable recruitment actuator system of claim 1, wherein the plurality of actuators are disposed symmetrically about a centerline of the variable recruitment actuator system.

12. A variable recruitment actuator system, comprising:

a housing, comprising:

a high-pressure fluid connection;

a plurality of McKibben muscles, each of the plurality of McKibben muscles coupled at one end to the housing; and a hydraulic piston configured to selectively enable fluid communication between a subset of a plurality of inlets in fluid communication with the plurality of McKibben muscles and the high-pressure fluid connection, such that a position of the hydraulic piston selectively pressurizes a subset of the plurality of McKibben muscles; and a control system to:

control the position of the hydraulic piston based on an input from a user;

determine a power output based on the input from the user;

use a relative pressure differential of the subset of the plurality of McKibben muscles to determine an actual power output; and adjust the position of the hydraulic piston to adjust the subset of the plurality of McKibben muscles.

* * * * *